US009115953B1

(12) United States Patent
Huang

(10) Patent No.: US 9,115,953 B1
(45) Date of Patent: Aug. 25, 2015

(54) TUBULAR AXLE FOR ARCHERY BOW CAM

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 14/627,253

(22) Filed: Feb. 20, 2015

(51) Int. Cl.
*F41B 5/14* (2006.01)
*F41B 5/10* (2006.01)
*F41B 5/00* (2006.01)

(52) U.S. Cl.
CPC ..... *F41B 5/1403* (2013.01); *F41B 5/10* (2013.01); *F41B 5/105* (2013.01); *Y10S 124/90* (2013.01)

(58) Field of Classification Search
CPC ..... F41B 5/105; F41B 5/10; F41B 5/14; F41B 5/1403; Y10S 124/90
USPC ..... 124/25.6, 86, 900
See application file for complete search history.

(56) References Cited

U.S. PATENT DOCUMENTS

| | | | | | |
|---|---|---|---|---|---|
| 2,256,065 | A * | 9/1941 | Urschel et al. | ..... | 295/36.1 |
| 2,313,116 | A * | 3/1943 | Babcock | ..... | 72/342.1 |
| 4,064,862 | A * | 12/1977 | Groner | ..... | 124/25.6 |
| 4,353,346 | A * | 10/1982 | Barna | ..... | 124/25.6 |
| 4,438,753 | A * | 3/1984 | Simonds | ..... | 124/25.6 |
| 4,770,154 | A * | 9/1988 | Cook et al. | ..... | 124/25.6 |
| 4,887,582 | A * | 12/1989 | Chattin | ..... | 124/25.6 |
| 5,054,462 | A * | 10/1991 | Larson | ..... | 124/25.6 |
| 5,678,529 | A * | 10/1997 | Larson | ..... | 124/25.6 |
| 5,697,355 | A * | 12/1997 | Schaffer | ..... | 124/25.6 |
| 6,082,346 | A * | 7/2000 | Andrews et al. | ..... | 124/25.6 |
| 6,415,780 | B1 * | 7/2002 | Proctor | ..... | 124/25.6 |
| 6,450,068 | B1 * | 9/2002 | Hu | ..... | 81/63.2 |
| 6,474,324 | B1 * | 11/2002 | Despart et al. | ..... | 124/25.6 |
| 6,516,790 | B1 * | 2/2003 | Darlington | ..... | 124/25.6 |
| 6,871,643 | B2 * | 3/2005 | Cooper et al. | ..... | 124/25.6 |
| 6,964,271 | B2 * | 11/2005 | Andrews | ..... | 124/25.6 |
| 6,976,484 | B1 * | 12/2005 | Gallops, Jr. | ..... | 124/25.6 |
| 7,441,555 | B1 * | 10/2008 | Larson | ..... | 124/25.6 |
| 7,938,109 | B1 * | 5/2011 | Larson | ..... | 124/25.6 |
| 7,971,582 | B1 * | 7/2011 | Larson | ..... | 124/25.6 |
| 8,056,548 | B1 * | 11/2011 | Larson | ..... | 124/89 |
| 8,069,848 | B1 * | 12/2011 | Larson | ..... | 124/25.6 |
| 8,281,774 | B2 * | 10/2012 | Grace | ..... | 124/25.6 |
| 8,281,775 | B1 * | 10/2012 | Larson | ..... | 124/25.6 |
| 8,408,193 | B2 * | 4/2013 | McPherson | ..... | 124/25.6 |
| 8,528,534 | B2 * | 9/2013 | McPherson | ..... | 124/25.6 |
| 8,683,989 | B1 * | 4/2014 | McPherson | ..... | 124/25.6 |
| 8,826,894 | B1 * | 9/2014 | Darlington et al. | ..... | 124/25.6 |
| 8,991,376 | B2 * | 3/2015 | McPherson | ..... | 124/25.6 |
| 2006/0011190 | A1 * | 1/2006 | Andrews | ..... | 124/89 |
| 2010/0263650 | A1 * | 10/2010 | Dahl et al. | ..... | 124/25.6 |
| 2012/0298087 | A1 * | 11/2012 | Trpkovski | ..... | 124/25 |
| 2013/0037012 | A1 * | 2/2013 | Gaus et al. | ..... | 124/4 |
| 2013/0213373 | A1 * | 8/2013 | Biafore et al. | ..... | 124/25 |

* cited by examiner

*Primary Examiner* — Alexander Niconovich
(74) *Attorney, Agent, or Firm* — Donald J. Ersler

(57) ABSTRACT

A tubular axle for an archery bow cam preferably includes a pair of bearing blocks, a pair of bearings, a tubular axle and a pair of retention clips. The bearing block includes a bearing bore, which is sized to receive the bearing. An attachment hole is formed in each end of the bearing block. The bearing is pressed into the bearing bore. The bearing block is attached to the rectangular limb with two fasteners or the like. The tubular axle is inserted through the pair of bearings and a hub of a cam. Each end of the tubular axle is slotted to receive the pair of retention clips. A tubular axle for an archery bow with tubular limbs includes a pair of bearing blocks, which adapted for attachment to the tubular limbs.

19 Claims, 4 Drawing Sheets

TUBULAR AXLE FOR ARCHERY BOW CAM

BACKGROUND OF THE INVENTION

1. Field of the Invention

The present invention relates generally to archery and more specifically to a tubular axle for an archery bow cam, which prevents twisting of a cam axle relative to the limb.

2. Discussion of the Prior Art

It appears that the prior art does not teach or suggest a cam being pivotally supported by a tubular axle in an archery bow limb. However, because of the thin rectangular cross section of typical archery bow limbs, it is preferable to use a tubular limb fabricated from carbon fiber. The diameter of a cam axle is about 3 mm. The small diameter of 3 mm is susceptible to twisting, when an arrow is shot from the archery bow. Increasing a diameter of the bow axle will prevent twisting thereof. It is preferable that the axle has a diameter of about 11-12 mm and that the axle be a tube to reduce weight and increase strength thereof.

Accordingly, there is a clearly felt need in the art for a tubular axle for an archery bow cam, which prevents twisting of a cam axle relative to a limb; decreases weight of the cam axle; and enables an arrow to be shot straighter and further than that of the prior art.

SUMMARY OF THE INVENTION

The present invention provides a tubular axle for an archery bow cam, which prevents twisting of a cam axle relative to the limb. The tubular axle for an archery bow cam preferably includes a pair of bearing blocks, a pair of bearings, a tubular axle and a pair of retention clips. The bearing block includes a bearing bore, which is sized to receive the bearing. An attachment hole is preferably formed in each end of the bearing block. The bearing is pressed into the bearing bore. The bearing block is attached to the rectangular limb with two fasteners or the like. The tubular axle is inserted through the pair of bearings and a hub of a cam. A pair of retention slots are formed in each end of the tubular axle to receive the pair of retention clips.

A tubular axle for an archery bow with tubular limbs preferably includes a pair of projection bearing blocks, the pair of bearings, the tubular axle and the pair of retention clips. The bearing block includes a bearing portion and a projection portion. The projection portion extends from the bearing portion. The projection portion is sized to be firmly received by an inner perimeter of the tubular limb. A bearing bore is formed through the bearing portion to firmly receive the bearing. The bearing is pressed into the bearing bore. A centerline of the bearing bore is substantially perpendicular to a centerline of the projection portion. The tubular axle is inserted through the pair of bearings and a hub of a cam. A pair of retention slots are formed in each end of the tubular axle to receive the pair of retention clips.

A second embodiment tubular axle for an archery bow with tubular limbs preferably includes a pair of cavity bearing blocks, the pair of bearings, the tubular axle and the pair of retention clips. The cavity bearing block includes a bearing bore and at least one limb cavity. The bearing bore is formed through a width of the cavity bearing block to firmly receive the bearing. The bearing is pressed into the bearing bore. The limb cavity is formed in one end of the cavity bearing block. A centerline of the bearing bore is substantially perpendicular to a centerline of the limb cavity. The tubular axle is inserted through the pair of bearings and a hub of a cam. A pair of retention slots are formed in each end of the tubular axle to receive the pair of retention clips.

Accordingly, it is an object of the present invention to provide a tubular axle for an archery bow cam, which prevents twisting of a cam axle relative to the limb.

It is another object of the present invention to provide a tubular axle for an archery bow cam, which decreases weight of the cam axle.

Finally, it is another object of the present invention to provide a tubular axle for an archery bow cam, which enables an arrow to be shot straighter and further than that of the prior art.

These and additional objects, advantages, features and benefits of the present invention will become apparent from the following specification.

DETAILED DESCRIPTION OF THE PREFERRED EMBODIMENTS

Figure 1:
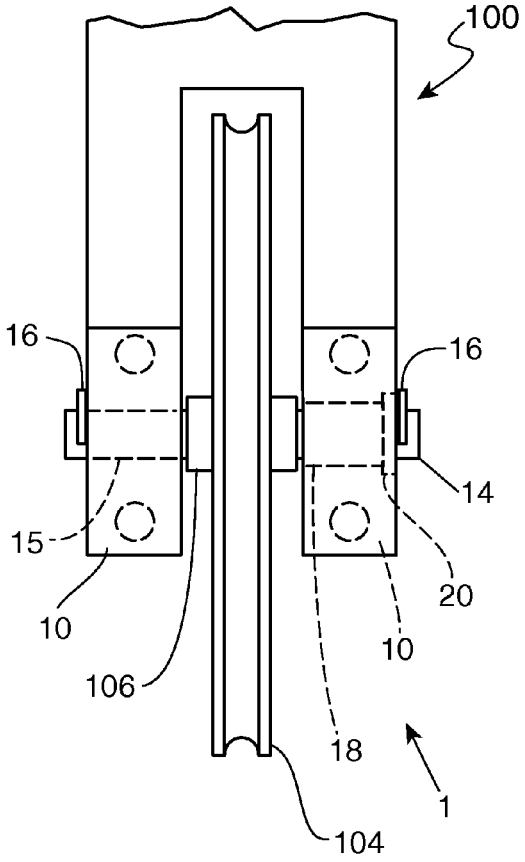
FIG. 1 is a top view of a tubular axle for an archery bow cam in accordance with the present invention.
Figure 2:
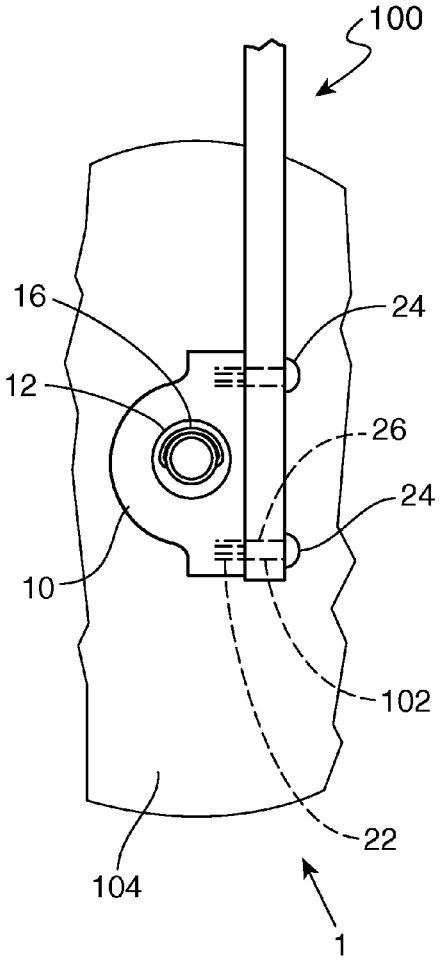
FIG. 2 is an end view of a tubular axle for an archery bow cam in accordance with the present invention.
Figure 7:
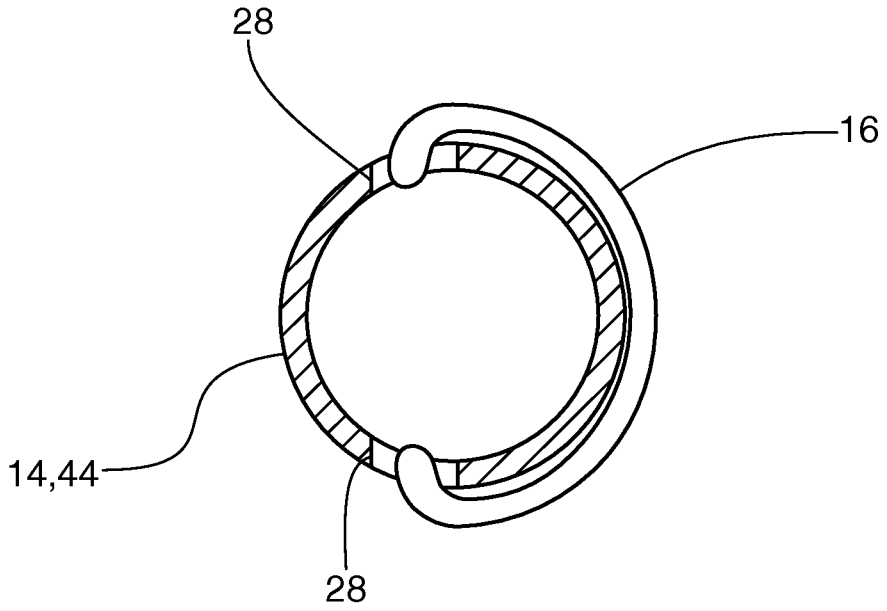
FIG. 7 is a cross sectional view of a retention clip retained on an end of a tubular axle with a pair of through slots in accordance with the present invention.
Figure 8:
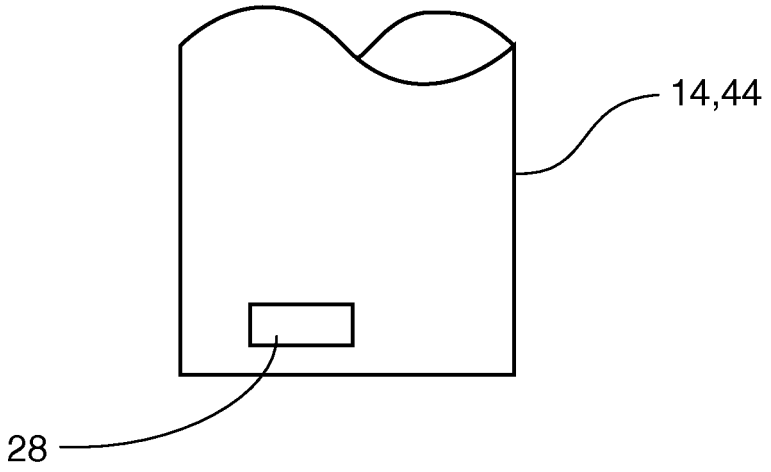
FIG. 8 is a top view of a tubular axle with a pair of through slots in accordance with the present invention.

With reference now to the drawings, and particularly to FIG. 1, there is shown a top view of a tubular axle for an archery bow cam 1. With reference to FIG. 2, the tubular axle for an archery bow cam 1 preferably includes a pair of bearing blocks 10, a pair of bearings 12, a tubular axle 14 and a pair of retention clips 16. The bearing 12 is preferably a flange bearing, but other types of bearings may also be used. An axle bore 15 may be formed in the bearing block 10 to receive one end of the tubular axle 14. The bearing block 10 includes a bearing bore 18 and a bearing counterbore 20, which are sized to receive the flange bearing 12. The flange bearing 12 is pressed into the bearing bore 18. A tapped hole 22 is preferably formed in each end of the bearing block 10. A plurality of limb holes 102 are formed through a limb 100 of a bow. A threaded fastener 24 is inserted through a limb hole 26 and tightened in the tapped hole 22. However, other methods may be used to attach the bearing blocks 10 to the limb 100. The tubular axle 14 is inserted through the pair of flange bearings 12 and a hub 106 of a cam 104. The tubular axle 14 is preferably fabricated from carbon fiber, titanium or any other suitable material. With reference to FIGS. 7-8, a pair of retention slots 28 are formed in each end of the tubular axle 14 to receive the retention clip 16. The retention clip 16 is preferably a C-clip. However, other suitable retention devices may also be used.

Figure 3:
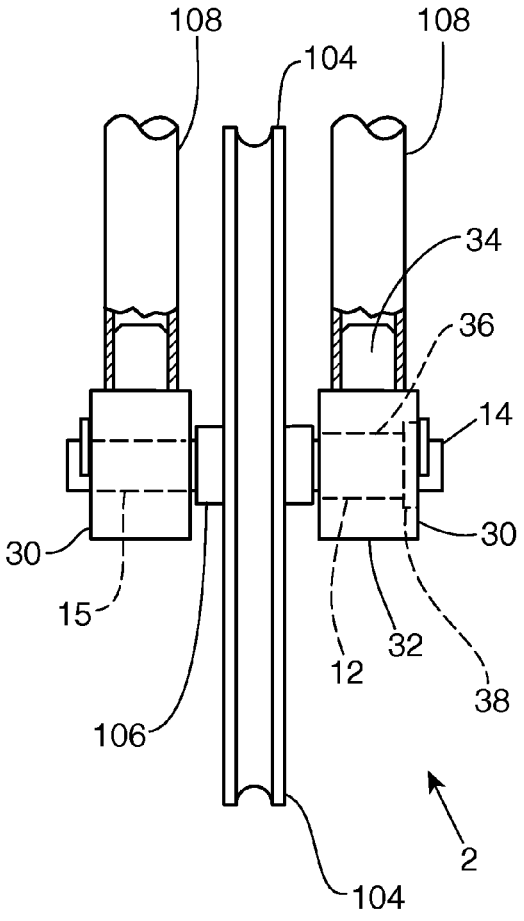
FIG. 3 is a top view of a tubular axle for an archery bow cam with tubular limbs in accordance with the present invention.
Figure 4:
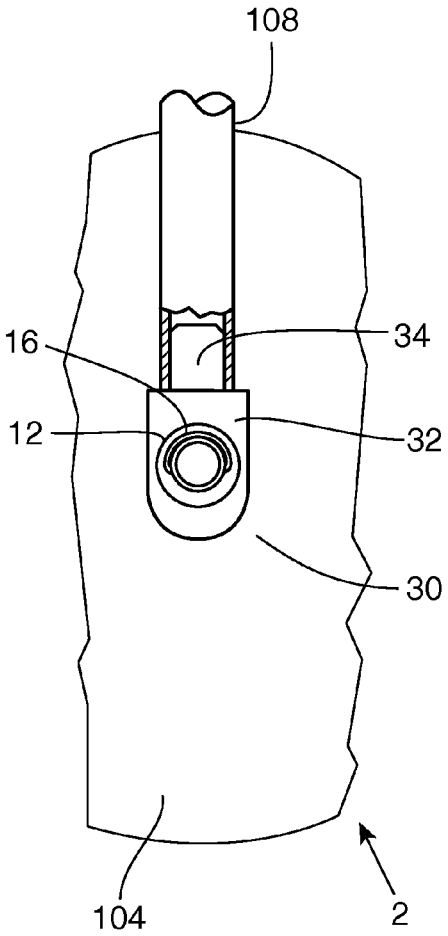
FIG. 4 is an end view of a tubular axle for an archery bow cam with tubular limbs in accordance with the present invention.

With reference to FIGS. 3-4, a tubular axle for an archery bow with tubular limbs 2 preferably includes a pair of projection bearing blocks 30, the pair of bearings 12, the tubular axle 14 and the pair of retention clips 16. The bearing 12 is preferably a flange bearing, but other types of bearings may also be used. An axle bore 15 may be formed in the projection bearing block 30 to receive one end of the tubular axle 14. The projection bearing block 30 includes a bearing portion 32 and a projection portion 34. The projection portion 34 extends from the bearing portion 32. The projection portion 34 is sized to be firmly received by an inner perimeter of the tubular limb 108. The bearing portion 32 includes a bearing bore 36 and a bearing counterbore 38, which are sized to receive the flange bearing 12. flange bearing 12 is pressed into the bearing bore 32. The tubular axle 14 is inserted through the pair of flange bearings 12 and the hub 106 of the cam 104. The tubular axle 14 is preferably fabricated from carbon fiber, titanium or any other suitable material. With reference to FIGS. 7-8, a pair of retention slots 28 are formed in each end of the tubular axle 14 to receive the retention clip 16. However, other suitable retention devices may also be used.

Figure 5:
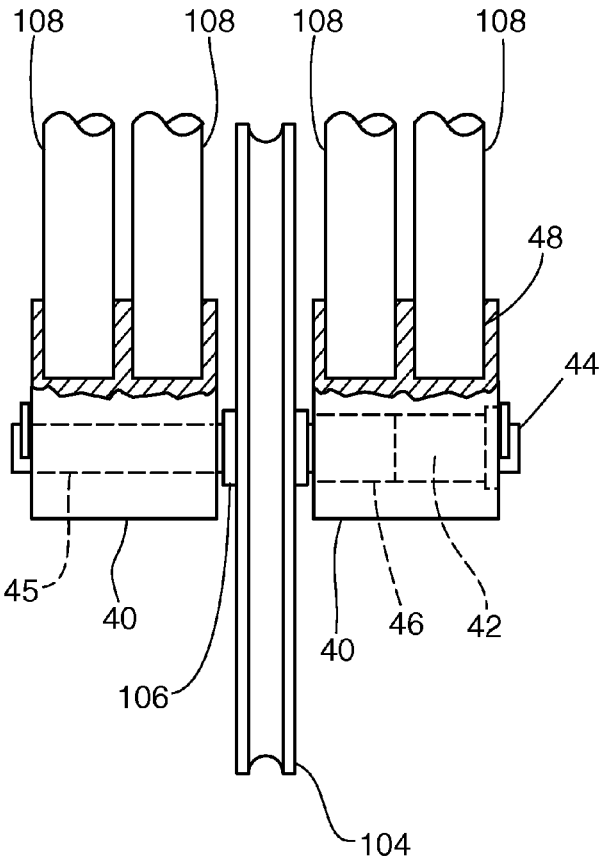
FIG. 5 is a top view of a second embodiment of a tubular axle for an archery bow cam with tubular limbs in accordance with the present invention.
Figure 6:
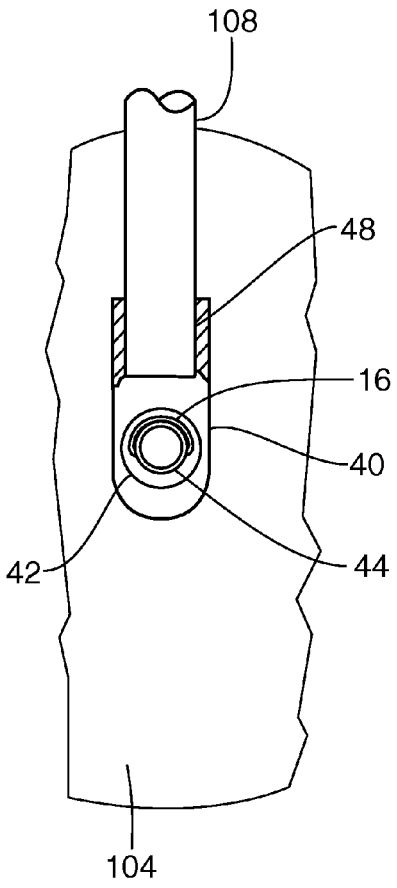
FIG. 6 is an end view of a second embodiment of a tubular axle for an archery bow cam with tubular limbs in accordance with the present invention.

With reference to FIGS. 5-6, a second embodiment of the tubular axle for an archery bow with tubular limbs 3 preferably includes a pair of cavity bearing blocks 40, a pair of flange bearings 42, a tubular axle 44 and the pair of retention clips 16. The bearing 42 is preferably a flange bearing, but other types of bearings may also be used. An axle bore 45 may be formed in the cavity bearing block 40 to receive one end of the tubular axle 14. The cavity bearing block 40 includes a bearing bore 46 and at least one limb cavity 48. The bearing bore 46 is formed through a width of the cavity bearing block 40 to firmly receive the flange bearing 42. The flange bearing 42 is pressed into the bearing bore 46. The limb cavity 48 is formed in one end of the cavity bearing block 40. A centerline of the bearing bore 46 is substantially perpendicular to a centerline of the limb cavity 48. The tubular axle 44 is inserted through the pair of flange bearings 42 and the hub 106 of the cam 104. The tubular axle 14 is preferably fabricated from carbon fiber, titanium or any other suitable material. With reference to FIGS. 7-8, a pair of retention slots 28 are formed in each end of the tubular axle 14 to receive the retention clip 16. However, other suitable retention devices may also be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A tubular axle for retaining an archery bow cam comprising:

a tubular axle having an outer diameter, a hollow area defining an inner perimeter is formed inside said outer diameter, said inner perimeter extending substantially from one end of said tubular axle to an opposing end thereof, said tubular axle is retained in the archery bow cam, a substantially uniform wall thickness defining said inner perimeter relative to said outer diameter; and a limb extends from an archery bow riser, each end of said tubular axle is pivotally retained on a distal end of the limb.

2. The tubular axle for retaining an archery bow cam of claim 1, further comprising:

a pair of bearing blocks, each one said pair of bearing blocks includes a bearing bore, said pair of bearings blocks are attached to the distal end of the limb.

3. The tubular axle for retaining an archery bow cam of claim 2, further comprising:

at least one bearing is inserted into said bearing bore, said bearing is sized to receive said outer diameter of said tubular axle.

4. The tubular axle for retaining an archery bow cam of claim 1 wherein:

each end of said tubular axle is terminated with a pair of retention devices secured to each end thereof.

5. The tubular axle for retaining an archery bow cam of claim 4 wherein:

said pair of retention devices are a pair C-clips, a pair of slots are formed through each end of said tubular axle to receive said pair of C-clips, a portion of said C-clips extend into said inner perimeter.

6. The tubular axle for retaining an archery bow cam of claim 1 wherein:

said tubular axle is fabricated from one of carbon fiber and titanium.

7. The tubular axle for retaining an archery bow cam of claim 2, further comprising:

said pair of bearing blocks are attached to the limb with a plurality of fasteners.

8. A tubular axle for retaining an archery bow cam with a pair of tubular limbs comprising:

a tubular axle having an outer diameter, a hollow area defining an inner perimeter is formed inside said outer diameter, said inner perimeter extending substantially from one end of said tubular axle to an opposing end thereof, a substantially uniform wall thickness defining said inner perimeter relative to said outer diameter; and a pair of bearing blocks, each one said pair of bearing blocks includes a bearing portion and a projection portion, said projection portion extends from said bearing portion, said bearing portion pivotally retains one end of said tubular axle, wherein a pair of tubular limbs extend from a riser of an archery bow, a distance between said pair of tubular limbs is sized to receive the archery bow cam, said pair of projection portions are sized to be inserted into an inner perimeter of the pair of tubular limbs.

9. The tubular axle for retaining an archery bow cam with tubular limbs of claim 8 wherein:

a bearing bore is formed in said bearing portion, at least one bearing is inserted into said bearing bore, said bearing is sized to receive said tubular axle.

10. The tubular axle for retaining an archery bow cam with tubular limbs of claim 8 wherein:

each end of said tubular axle is terminated with a pair of retention devices secured to each end thereof.

11. The tubular axle for retaining an archery bow cam with tubular limbs of claim 10 wherein:

said pair of retention devices are a pair C-clips, a pair of slots are formed through each end of said tubular axle to receive said pair of C-clips, a portion of said C-clips extend into said inner perimeter.

12. The tubular axle for retaining an archery bow cam with tubular limbs of claim 9 wherein:

said bearing is a flange bearing.

13. The tubular axle for retaining an archery bow cam with a pair of tubular limbs of claim 8 wherein:

a centerline of said tubular axle is substantially perpendicular to a centerline of said projection portion.

14. The tubular axle for retaining an archery bow cam of claim 8 wherein:

said tubular axle is fabricated from one of carbon fiber and titanium.

15. A tubular axle for retaining an archery bow cam with tubular limbs comprising:

a tubular axle having an outer diameter, a hollow area defining an inner perimeter is formed inside said outer diameter, said inner perimeter extending substantially from one end of said tubular axle to an opposing end thereof, a substantially uniform wall thickness defining said inner perimeter relative to said outer diameter; and a pair of bearing blocks, each one said pair of bearing blocks includes at least one limb cavity, said bearing block pivotally retains one end of said tubular axle, wherein at least two tubular limbs extend from a riser of an archery bow, a distance between said at least two tubular limbs is sized to receive the archery bow cam, said at least two limb cavities are sized to receive an outer perimeter of said at least two tubular limbs.

16. The tubular axle for retaining an archery bow cam with tubular limbs of claim 15 wherein:

a bearing bore is formed in said bearing portion, at least one bearing is inserted into said bearing bore, said bearing is sized to receive said tubular axle.

17. The tubular axle for retaining an archery bow cam with tubular limbs of claim 15 wherein:

each end of said tubular axle is terminated with a pair of retention devices secured to each end thereof.

18. The tubular axle for retaining an archery bow cam with tubular limbs of claim 16 wherein:

said pair of retention devices are a pair C-clips, a pair of slots are formed through each end of said tubular axle to receive said pair of C-clips, a portion of said C-clips extend into said inner perimeter.

19. The tubular axle for retaining an archery bow cam with a pair of tubular limbs of claim 15 wherein:

a centerline of said tubular axle is substantially perpendicular to a centerline of said projection portion.

* * * * *